US006298993B1

(12) United States Patent
Kalozdi

(10) Patent No.: US 6,298,993 B1
(45) Date of Patent: Oct. 9, 2001

(54) DIAPER BAG

(76) Inventor: Monica E Kalozdi, 740 Clouet St., New Orleans, LA (US) 70117

( * ) Notice: Subject to any disclaimer, the term of this patent is extended or adjusted under 35 U.S.C. 154(b) by 0 days.

(21) Appl. No.: 09/633,012

(22) Filed: Aug. 4, 2000

(51) Int. Cl.[7] ..... B65D 69/00

(52) U.S. Cl. ..... 206/581; 150/106; 190/109; 383/40

(58) Field of Search ..... 206/581, 37, 38, 206/823; 150/106, 107, 117; 190/1, 109; 224/264; 132/315; 383/4, 6, 38–40, 23, 121.1

(56) References Cited

U.S. PATENT DOCUMENTS

| | | | | |
|---|---|---|---|---|
| 1,089,939 | | 3/1914 | Maxwell . | |
| 1,927,624 | | 9/1933 | Appel . | |
| 2,130,502 | | 10/1938 | Lindemanu . | |
| 2,331,428 | | 10/1943 | Selezneff . | |
| 2,844,141 | | 7/1958 | Daugherty . | |
| 2,904,091 | | 9/1959 | Reed . | |
| 2,937,680 | | 5/1960 | Dumas . | |
| 2,988,125 | | 6/1961 | Reynolds . | |
| 3,139,133 | * | 6/1964 | Spector | 383/23 |
| 3,335,775 | | 8/1967 | Adams . | |
| 3,759,356 | | 9/1973 | Bostic . | |
| 4,463,789 | * | 8/1984 | Leiserson | 383/38 |
| 4,489,815 | * | 12/1984 | Martinez | 190/1 |
| 4,566,130 | | 1/1986 | Coates . | |
| 4,574,822 | | 3/1986 | Helinsky . | |
| 4,685,559 | | 8/1987 | Titus . | |
| 4,706,845 | | 11/1987 | Schnurer . | |
| 4,781,277 | | 11/1988 | Lim . | |
| 5,251,743 | * | 10/1993 | Pulido et al. | 383/4 |
| 5,439,154 | | 8/1995 | Delligatti . | |
| 5,743,649 | | 4/1998 | Gonzales . | |
| 6,039,474 | * | 3/2000 | DeChant | 383/39 |
| 6,109,443 | * | 8/2000 | Dercole | 206/581 |

* cited by examiner

*Primary Examiner*—Luan K. Bui
(74) *Attorney, Agent, or Firm*—David S. Thompson

(57) ABSTRACT

A diaper bag (10) provides an enclosure (20) includes a top, bottom, front, back and side panels. The front panel is attached to the side and top panels by a zipper, allowing access to an interior compartment. Two back panel interior compartments (40) are made of mesh and may be sealed by separate zippers. Front panel interior compartments (60) include a full-width zipped pocket upon which are mounted four pleated front panel pockets made of mesh with elastic closures. A changing pad (80) is carried in the bottom of the interior compartment, and may be removed for use. A flip-out compartment array (100) is attached to an upper portion of the front wall. When the enclosure is opened, the flip-out compartment array may be removed from the interior compartment. A support assembly (200) carries the entire diaper bag by a tab located on an upper portion of the flip-out compartment, thereby orienting all compartments for easy access. At least one base interior compartment (120) is attached to the bottom panel. Front and back external compartments (140), (160) are defined between the front and back panels and a clear plastic and a mesh panel, respectively, and are accessible without opening the enclosure. A tethered compartment (180) is attached to the interior of the enclosure by a line, and includes a zippered pocket which is removable from the enclosure for easier access.

11 Claims, 3 Drawing Sheets

DIAPER BAG

CROSS-REFERENCES

There are no applications related to this application filed in this or any foreign country.

BACKGROUND

A number of diaper bags are known. Most attempt to address the issue of carrying the numerous items that may assist those involved in the diaper changing process, such as food, clothing and toys. However, the increasing number of disposable items sold for child care has complicated matters, and as a result parents look for progressively more flexible bags, able to carry a particular desired mix of products. As a result, a number of bags have been developed, each having a different structure addressing the similar problems. However, no one bag is viewed by the public as a single solution to the problem of storage and transport of diapers and accessories.

The primary problem with most diaper bags is difficulty in supporting the bag during use. Where the bag is poorly supported, access to the compartments is compromised. Also, in many changing locations, there is no clean and clear surface upon which to rest the diaper bag, and any such surface must be used for the baby.

Most diaper bags are soft-sided, and due to lack of support, tend to collapse when opened. In the collapsed state, the diaper bag assumes the shape of its contents, collectively. This is not conducive to rapid and convenient assess of the various compartments which may be available.

A second problem with most diaper bags is the lack of flexibility; i.e. a lack of storage compartments in adequate number, size and configuration, and lack of the extra features which interact synergistically with the storage features of the diaper bag.

For the foregoing reasons, there is a need for diaper organizer bag that provides a means to support the diaper bag during periods of use, a number of compartments that are easily accessed and conveniently appointed, and a variety of additional features that interact synergistically with the first two, providing in combination a diaper bag conferring superior convenience, service and utility.

SUMMARY

The present invention is directed to an apparatus that satisfies the above needs. A novel diaper bag is disclosed that provides a support assembly which convenient access to the bad during use, a number of compartments that are easily accessed and conveniently appointed, in combination with a variety of additional features that interact synergistically, providing in combination a diaper bag conferring superior convenience, service and utility.

The diaper bag of the present invention provides some or all of the following structures.

(A) A six-sided enclosure includes a front, back, top, bottom and side panels. A zipper allows the front panel to be detached from the side and top panels, allowing access to the interior of the enclosure. A handle strap allows the enclosure to be carried in the manner of a shoulder bag; while front and back handles allow the enclosure to be carried in the manner of a handbag.

(B) In a preferred embodiment, two back panel interior compartments are carried by the back panel, and are accessible from the interior of the enclosure. Preferably, each back panel interior compartments is made of mesh to provide ventilation and visibility, and includes a zipper to allow the contents to be secured in place.

(C) In a preferred embodiment, a full-width front zippered pocket is defined between an inside front panel and the front panel, and is accessible from the interior of the enclosure.

(D) At least two, and preferably four, pleated front panel pockets are defined between the inside front panel and a pleated mesh body attached to the inside front panel. The pleated front pockets are accessible from the interior of the enclosure and are secured by an elastic closure attached to the inside front panel.

(E) In an unfolded state, a changing pad having a water resistant cover and an insulative core is sized for supporting a baby during the diaper changing process. In a folded state, the changing pad is sized for transport within the interior of the enclosure, adjacent to the bottom panel.

(F) A flip-out compartment array is attached to an upper edge of the front panel. A preferred version of the flip-out compartment array includes a full-width inner compartment and two half-width outer compartments. The flip-out compartment array is carried within the enclosure when it is closed and the front panel is secured to the side and top panels. However, when the enclosure is opened, the flip-out compartment may easily be moved from the interior of the enclosure for more convenient access.

(G) A preferred support assembly includes a hook and a fastener connected by a chain. The fastener attaches to a tab on the flip-out compartment array, while the hook is sized to fit over the top of a door, toilet stall or other available supporting structure. Webbing present between the front and side panels keeps the back panel generally horizontal while the front panel and flip-out compartment are vertical.

(H) One or more base interior compartments are attached to the base panel of the enclosure.

(I) A front external compartment and a back external compartment are formed by an opaque plastic panel and a clear plastic panel carried by the front and back panels, respectively. These compartments provide added convenience because they can be accessed without opening the enclosure.

(J) A tethered compartment is attached to an interior point within the enclosure by a line. When the enclosure is opened, the tethered compartment may easily be completely removed from the enclosure for ease of access. When the enclosure is closed, the tethered compartment will not be left behind, due to the tether line.

It is therefore a primary advantage of the present invention to provide a novel diaper bag having a support assembly which holds the diaper bag open during use so that a combination of compartments, storage spaces, fasteners and handles can provide, in overall combination, greater convenience, capacity and versatility than known diaper bags.

Another advantage of the present invention is to provide a novel diaper bag having the combination of flip-out compartment array and a tethered compartment which allow far greater access to these storage areas than in conventional diaper bags, which do not allow removal of the storage compartments from the bag, even when open.

A still further advantage of the present invention is to provide a novel diaper bag having a combination of compartments which, when the enclosure portion of the bag is in the open state, are more readily accessible and better distributed for ease of removal and storage of items than are compartments of conventional diaper bags.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

DESCRIPTION

Figure 1:
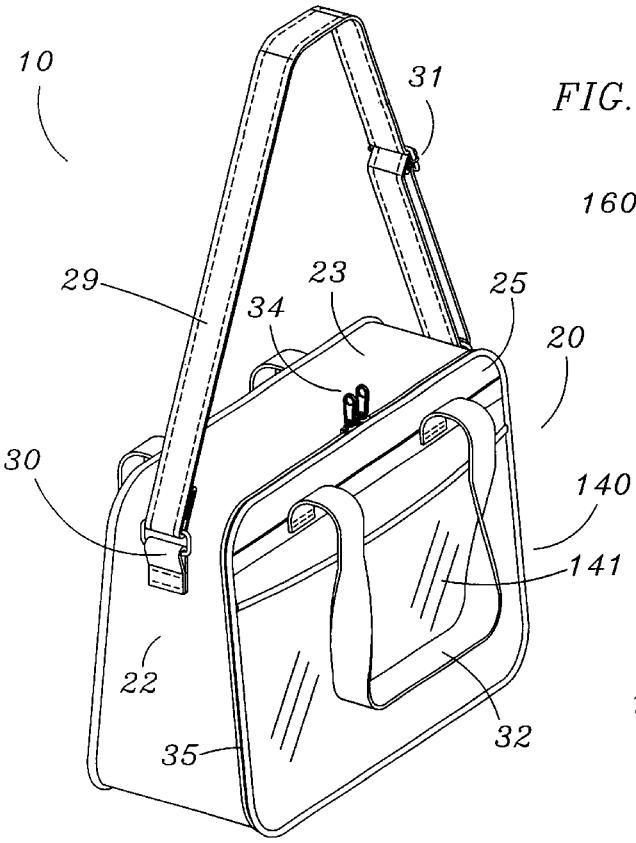
FIG. 1 is a isometric view a version of the diaper bag of the invention, showing the top, side and front panels of the enclosure.
Figures 3, 4:
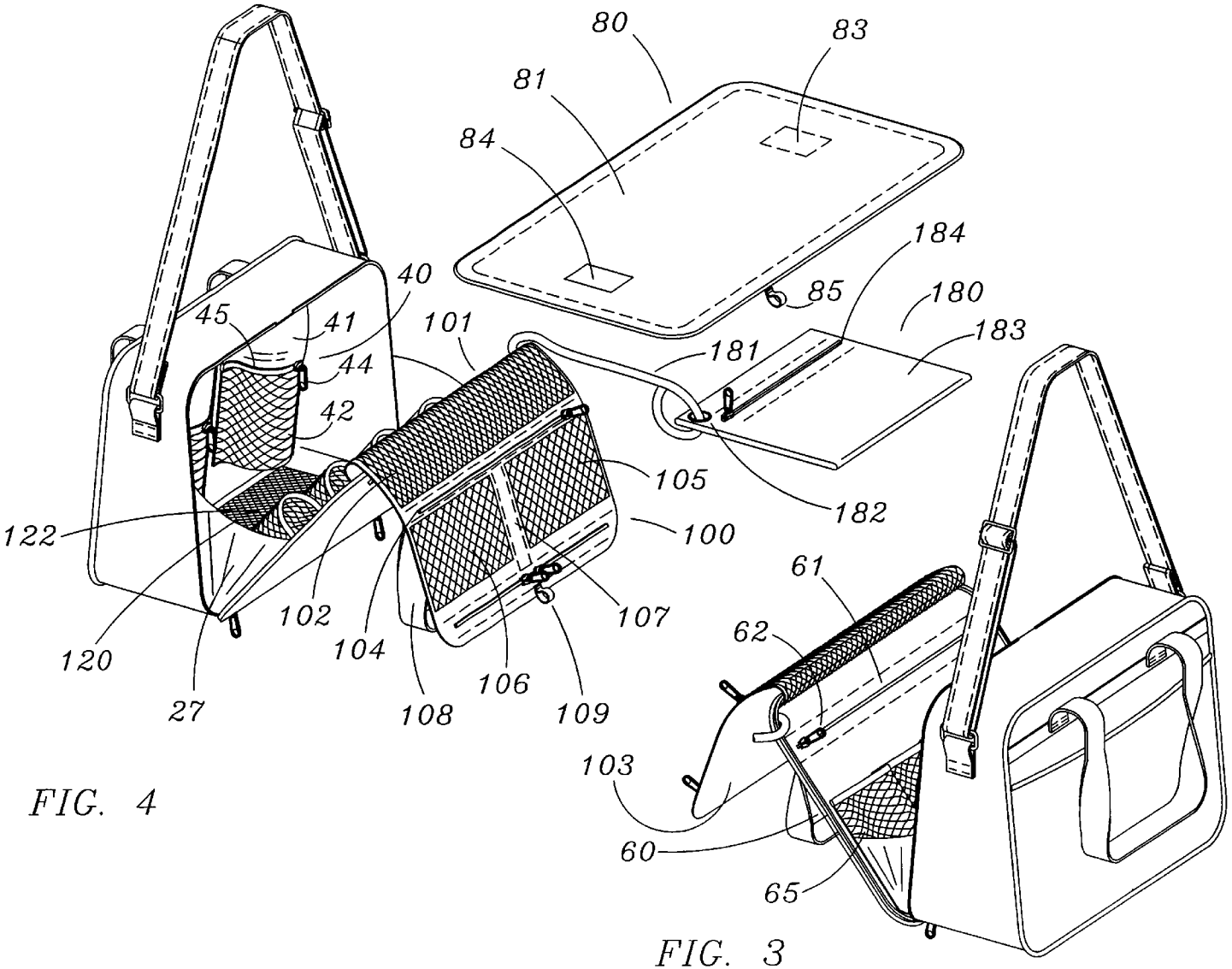
FIG. 3 is a isometric view of the diaper bag of FIG. 1, showing the enclosure in an open condition.
FIG. 4 is a view similar to that of FIG. 3, from the reverse angle, additionally illustrating the tethered compartment and changing pad.

Referring in generally to FIGS. 1 and 4, a diaper bag 10 constructed in accordance with the principles of the invention is seen. An enclosure 20 includes a top, bottom, front, back and side panels. The front panel is attached to the side and top panels by a zipper, allowing access to an interior compartment. Two back panel interior compartments 40 are made of mesh and may be sealed by separate zippers. Front panel interior compartments 60 include a full-width zipped pocket upon which are mounted four pleated front panel pockets made of mesh with elastic closures. A changing pad 80 is carried in the bottom of the interior compartment, and may be removed for use. A flip-out compartment array 100 is attached to an upper portion of the front wall. When the enclosure is opened, as seen in FIG. 4, the flip-out compartment array may be removed from the interior compartment. A support assembly 200 carries the entire diaper bag by a tap located on an upper portion of the flip-out compartment, thereby orienting all compartments for easy access. At least one base interior compartment 120 is attached to the bottom panel. Front and back external compartments 140, 160 are defined between the front and back panels and a clear plastic and a mesh panel, respectively, and are accessible without opening the enclosure. A tethered compartment 180 is attached to the interior of the enclosure by a line, and includes a zippered pocket which is removable from the enclosure for easier access.

Figure 5:
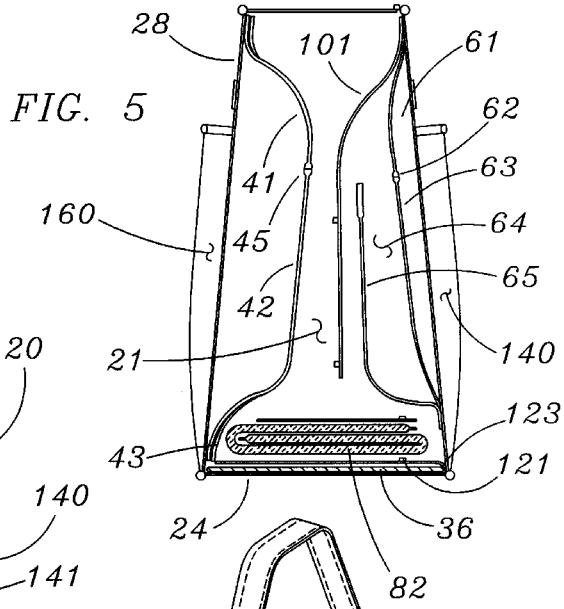
FIG. 5 is a cross-sectional view of the diaper bag of FIG. 1.
Figure 2:
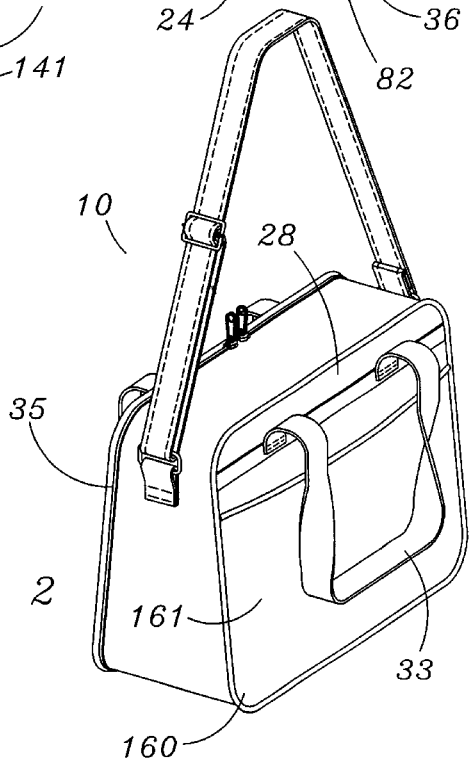
FIG. 2 is a isometric view of the diaper bag of FIG. 1, showing the top, side and back panels of the enclosure.

As seen in FIGS. 1, 2 and 5, a six-sided enclosure 20 includes a front panel 25, a back panel 28, a top panel 23, a bottom panel 24 and a pair of side panels 22. Within the enclosure is an interior storage area 21, which is typically used to store diapers, clothing and similar bulky supplies.

A base stiffener 36 provides a desirable degree of rigidity to the enclosure, which tends to facilitate loading and unloading and also provides a flat bottom which supports the ability of the enclosure to stand erect. A preferred base stiffener is a rigid card or thin board covered with fabric, having dimensions incrementally smaller in dimension than the bottom panel.

A fastener allows the front panel to be detached from the side and top panels, allowing access to the interior of the enclosure. In a preferred embodiment, a zipper having dual sliders 34 travels about a track 35 carried by the front, top and side panels, as seen in FIGS. 1 and 4.

Referring particularly to FIG. 4, the diaper bag 10 can be seen with the front panel in the open condition, allowing access to the interior storage area. Webbing 27 maintains the back panel interior compartments 40 in a somewhat horizontal orientation when the front panel interior compartments 60 and flip-out compartment array 100 are carried in a vertical orientation by the support assembly 200. Such an orientation prevents the baby bottles carried in the pleated front panel pockets from spilling, while allowing items stored within the area defined between the back, side, top and bottom panels from spilling.

The enclosure may be carried as a shoulder bag or as a hand bag. Referring particularly to FIGS. 1, 2, 4 and 5, a shoulder strap 29 allows the enclosure to be carried in the manner of a shoulder bag. The shoulder strap includes first and second bases 30, which are attached to the first and second side panels of the enclosure. An adjustable buckle 31 allows the length of the shoulder strap to be varied to suit individual requirements.

As seen in FIGS. 1 and 2, front and back handles allow the enclosure to be carried in the manner of a handbag. The front handle 32 is attached to the front panel, and the back handle 33 is attached to the back panel.

In a preferred embodiment, two back panel interior compartments 40 are carried by the back panel 28 of the enclosure 20. The back panel interior compartments are accessible only from the interior of the enclosure. Preferably, the back panel interior compartments are made at least partially of mesh to provide ventilation and visibility, and include a zipper or other fastener to allow the contents to be secured in place.

Referring particularly to FIGS. 4 and 5, the back panel interior compartments 40 are defined between an upper fabric portion 41, a lower mesh portion 42 and the back panel 28 of the enclosure 20. In a preferred embodiment, the horizontal length of the material used in the manufacture of both the upper and lower portions exceeds the horizontal length of the back panel 28. This results in the rounded appearance of the upper and lower portions 41, 42, seen in FIG. 4. Because the surface area of the upper and lower portions is greater than the portion of the back panel to which they are secured, the volume within the back panel compartments 40 is sufficient to carry bottles, cans or similarly sized objects. Also as a result of the difference between the length of the upper and lower portions and the back panel 28, pleats 43 result when the upper and lower panels are attached to the back panel, typically by sewing or other fastening means.

A fastener, such as a zipper or VELCRO(R), releasably fastens adjacent edges of the upper and lower panels 41, 42, thereby securing the interior compartments. In the preferred version seen in FIG. 4, corresponding zipper tracks 45 are secured by a zipper slider 44. Alternatively, corresponding patches of VELCRO(R) could be substituted for the zipper.

In a preferred embodiment, a plurality of front panel interior compartments 60 are carried by the front panel 25 of the enclosure 20. The front panel interior compartments are accessible from the interior 21, when the enclosure is opened.

Figure 6:
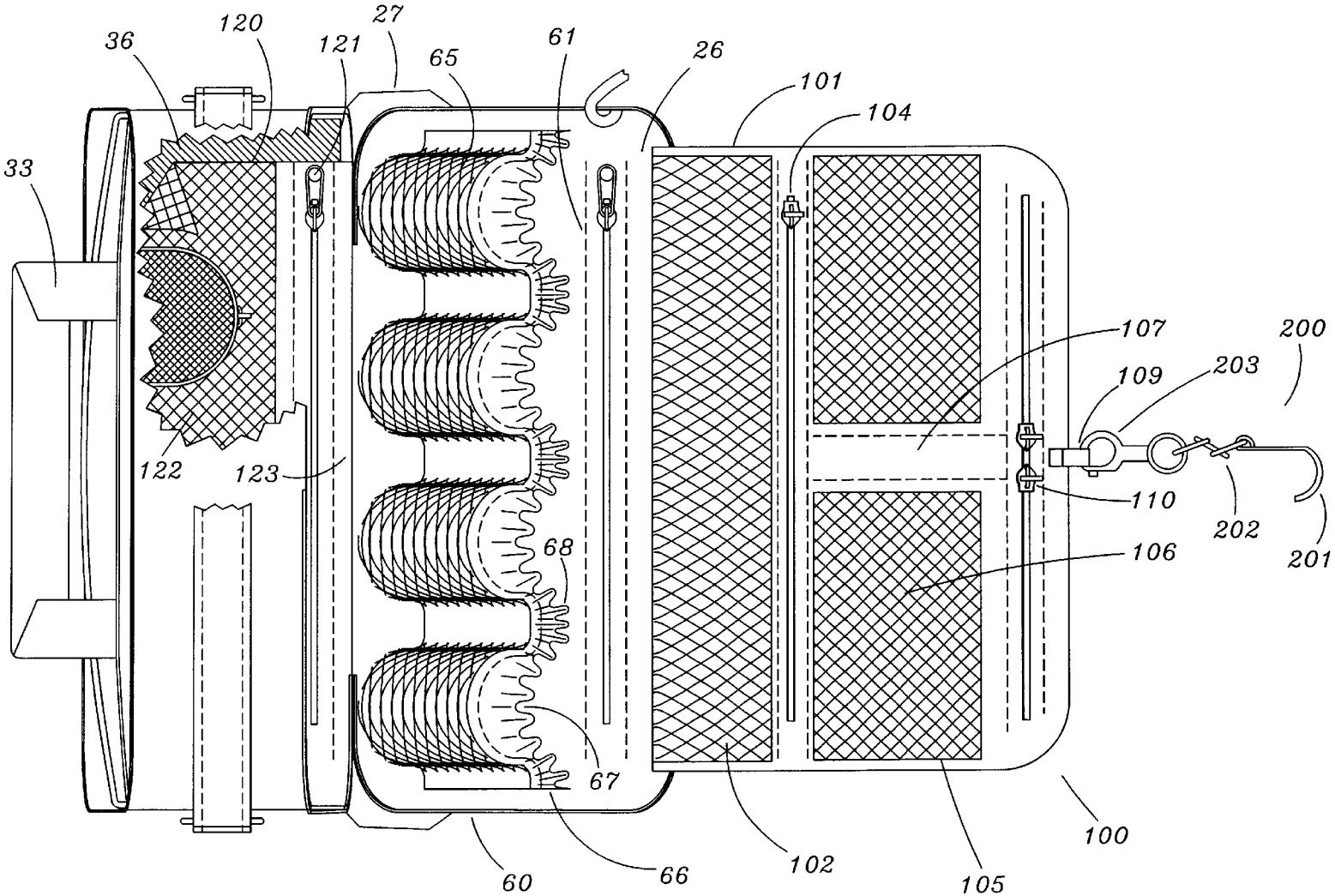
FIG. 6 is a top orthographic view of the diaper bag of FIG. 1, fully opened, particularly illustrating the orientation of the diaper bag in use while carried by the support assembly.

Referring in particular to FIGS. 3, 5 and 6, a full-width front zippered pocket 61 is defined between an inside front panel 63 and the front panel 25 of the enclosure. A zipper 62 is allows easy access to the interior of the full-width front zippered pocket, and allows it to be sealed to prevent loss of contents.

Referring particularly to FIGS. 5 and 6, at least two, and preferably four, pleated front panel pockets 64 are defined between the inside front panel 63 and a pleated mesh body 65 attached to the inside front panel. The pleated front pockets 64 are accessible from the interior of the enclosure when the front panel is unzipped from the side and top panels. The pleated front pockets are secured by an elastic closure 66 attached to the inside front panel 63. The elastic closure includes free elastic segments 67 and attached elastic segments 68. The free elastic segments typically assume a rounded state when in use, as seen in FIGS. 4 and 6, due to the shape of the baby bottles that are typically carried within the pockets. The attached elastic segments are typically sewn onto the inside front panel 63, as seen in FIG. 6.

A changing pad 80 is used to support the baby during the diaper changing process. The changing pad is seen in an unfolded state in FIG. 4, and in its folded state, within the enclosure 20, in the cross-sectional view of FIG. 5.

A preferred changing pad includes a water resistant cover 81 and an insulative core 82. Male and female VELCRO(R) patches 83, 84 are used to fasten the changing pad in the folded state.

The changing pad is sized to adequately support a baby while during the diaper changing process, yet to also fold conveniently into the diaper bag. A preferred size of approximately 11" by 21" could be varied somewhat, while still in keeping within the above design restrictions. Folded in thirds, the changing pad is sized for transport within the interior of the enclosure, adjacent to the bottom panel.

A tab 85 allows the changing pad to be tethered to the diaper bag by a line if desired.

As seen particularly in FIGS. 4, 5 and 6, a flip-out compartment array 100 is attached to an upper edge 26 of the front panel 25. A preferred version of the flip-out compartment array includes a full-width inner compartment 101 and two half-width outer compartments 105. The flip-out compartment array is carried within the enclosure when it is closed, i.e. when the front panel is secured to the side and top panels. However in use, when the enclosure is opened, the flip-out compartment array advantageously allows the entire compartment array to be removed from the enclosure for easy accessibility.

Referring particularly to FIGS. 4 and 6, the full-width inner compartment 101 is adjacent to the upper edge 26 of the front panel 25, and is defined between the solid back panel 103 and a full-width mesh panel 102. A full-width zipper 104 allows easy access to the contents, while preventing loss during storage.

Two half-width outer compartments 105 are defined between half-width mesh panel 106 and the solid back panel 103. A divider 107 separates the half-width compartments, preventing the contents of one compartment from moving into the other. A half-width zipper 110 secures the compartments. An expansion sidewall 108 results in greater depth in the compartments and increases storage room. A tab 109 allows for the attachment of a line 181 or any other device, such as keys, toys or the changing pad 80.

As seen in FIG. 6, a preferred support assembly 200 includes a hook 201 and a fastener 203 connected by a chain 202. The fastener attaches to a tab 109 on the flip-out compartment array 100, while the hook is sized to fit over the top of a door, toilet stall or other available supporting structure.

While the diaper bag 10 is carried by the support assembly, webbing 27 present between the front and side panels keeps the back panel generally horizontal while the front panel and flip-out compartment are vertical. This prevents items stored within the diaper bag Referring particularly to FIGS. 5 and 6, one or more base interior compartments 120 is attached to the base panel 30 of the enclosure 20. The attachment is typically made by sewing a perimeter attachment strip 123 of the base interior compartment to the base panel 30.

A preferred base interior compartment is made of mesh 122 or similar loosely woven fabric. The mesh provides ventilation to the contents of the compartment, and allows observation of the contents without opening the compartment. A zipper 121 or similar fastening device allows the compartment to be secured in a manner which prevents the contents from moving around in the interior 21 of the enclosure.

A front external compartment 140 and a back external compartment 160 are formed by a opaque plastic panel 141 and a clear plastic panel 161 carried by the front and back panels, 25, 28, respectively. These compartments provide added convenience because they can be accessed without opening the enclosure. While opaque plastic and clear plastic are used in the preferred embodiment, it is clear that mesh, fabric or other material could be substituted, while still resulting in many of the same advantages.

As seen particularly in FIGS. 4 and 5, a tethered compartment 180 is attached to an interior point within the enclosure by a line 181. When the enclosure is opened, the tethered compartment may easily be completely removed from the enclosure. Such removal results in easier access of the tethered compartment than would be possible if the tethered compartment were required to remain within the interior storage area 21 of the enclosure 20. The line 181 prevents loss of the tethered compartment, which could result accidentally due to failure to replace the compartment within the enclosure following use.

In a preferred embodiment, the tethered compartment 180 provides a clear plastic envelope 183 having a grommet 182 to which the line 181 is attached. Mesh, fabric or opaque plastic could alternatively be used. A zipper 184 or other fastener, such as VELCRO(R), allows the compartment to be sealed.

The previously described versions of the present invention have many advantages, including a primary advantage of providing a novel diaper bag having a support assembly which holds the diaper bag open during use so that a combination of compartments, storage spaces, fasteners and handles can provide, in overall combination, greater convenience, capacity and versatility than known diaper bags.

Another advantage of the present invention is to provide a novel diaper bag having the combination of flip-out compartment array and a tethered compartment which allow far greater access to these storage areas than in conventional diaper bags, which do not allow removal of the storage compartments from the bag, even when open.

A still further advantage of the present invention is to provide a novel diaper bag having a combination of compartments which, when the enclosure portion of the bag is in the open state, are more readily accessible and better distributed for ease of removal and storage of items than are compartments of conventional diaper bags.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while a preferred flip-out compartment array consists of a full-width inner compartment and a pair of half-width outer compartments, an alternative flip-out compartment array could consist of a full-width outer compartment and a pair of half-width inner compartments. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A diaper bag, comprising:

(A) a six-sided enclosure comprising:

(a) front, back, top, bottom and side panels and fastening means to allow the front panel to be detached from the side and top panels, thereby allowing access to an interior of the enclosure;

(b) a handle strap, having first and second ends carried by the side panels, thereby allowing the enclosure to be carried in the manner of a shoulder bag; and (c) front and back handles, carried by the front and back panels, respectively, thereby allowing the enclosure to be carried in the manner of a handbag;

(B) a flip-out compartment array, attached to an upper edge of the front panel, comprising a full-width inner compartment adjacent to two half-width outer compartments;

(C) a support assembly, attached to the flip-out compartment array; and (D) a tethered compartment and a line with a first end attached to an interior point within the enclosure and a second end attached to the tethered compartment.

2. The diaper bag of claim 1, additionally comprising:

(A) a changing pad having a water resistant cover and an insulative core, folded within the interior of the enclosure adjacent to the bottom panel.

3. The diaper bag of claim 2, additionally comprising:

(A) at least one base interior compartment attached to the base panel.

4. The diaper bag of claim 3, additionally comprising:

(A) a front external compartment, defined between the front panel and an opaque plastic panel; and (B) a back external compartment, defined between the back panel and a clear plastic panel.

5. The diaper bag of claim 4, additionally comprising:

(A) two back panel interior compartments, carried by the back panel and accessible from the interior of the enclosure.

6. The diaper bag of claim 1, additionally comprising:

(A) a full-width front zippered pocket, defined between an inside front panel and the front panel; and (B) at least two pleated front panel pockets, defined between the inside front panel and a pleated mesh body attached to the inside front panel, wherein the at least two pleated front pockets are accessible from the interior of the enclosure and are secured by an elastic closure attached to the inside front panel.

7. The diaper bag of claim 1, additionally comprising:

(A) a changing pad having a water resistant cover and an insulative core, folded and carried within the interior of the enclosure adjacent to the bottom panel.

8. The diaper bag of claim 1, additionally comprising:

(A) at least one base interior compartment attached to the base panel.

9. The diaper bag of claim 1, additionally comprising:

(A) a front external compartment, defined between the front panel and an opaque plastic panel; and (B) a back external compartment, defined between the back panel and a clear plastic panel.

10. The diaper bag of claim 1, additionally comprising:

(A) two back panel interior compartments, carried by the back panel and accessible from the interior of the enclosure.

11. A diaper bag, comprising:

(A) a six-sided enclosure comprising:

(a) front, back, top, bottom and side panels and fastening means to allow the front panel to be detached from the side and top panels, thereby allowing access to an interior of the enclosure;

(b) a handle strap, having first and second ends carried by the side panels, thereby allowing the enclosure to be carried in the manner of a shoulder bag; and (c) front and back handles, carried by the front and back panels, respectively, thereby allowing the enclosure to be carried in the manner of a handbag;

(B) two back panel interior compartments, carried by the back panel and accessible from the interior of the enclosure;

(C) a full-width front zippered pocket, defined between an inside front panel and the front panel;

(D) at least two pleated front panel pockets, defined between the inside front panel and a pleated mesh body attached to the inside front panel, wherein the at least two pleated front pockets are accessible from the interior of the enclosure and are secured by an elastic closure attached to the inside front panel;

(E) a changing pad having a water resistant cover and an insulative core, folded within the interior of the enclosure adjacent to the bottom panel;

(F) a flip-out compartment array, attached to an upper edge of the front panel, comprising a full-width inner compartment adjacent to two half-width outer compartments;

(G) a support assembly, attached to the flip-out compartment array.

(H) at least one base interior compartment attached to the base panel;

(I) a front external compartment, defined between the front panel and an opaque plastic panel;

(J) a back external compartment, defined between the back panel and a clear plastic panel; and (K) a tethered compartment and a line with a first end attached to an interior point within the enclosure and a second end attached to the tethered compartment.

* * * * *